United States Patent [19]

Brothers

[11] Patent Number: 4,702,504

[45] Date of Patent: Oct. 27, 1987

[54] CONTAINER LATCH

[75] Inventor: Jack Brothers, Ft. Walton Beach, Fla.

[73] Assignee: The United States of America as represented by the Secretary of the Air Force, Washington, D.C.

[21] Appl. No.: 889,650

[22] Filed: Jul. 24, 1986

[51] Int. Cl.[4] ..... E05C 5/00

[52] U.S. Cl. ..... 292/66; 16/259; 74/543; 292/336.3; 292/DIG. 31; 292/DIG. 49

[58] Field of Search ..... 292/DIG. 31, 336.3, 292/348, 349, 353, 355, DIG. 49, DIG. 53, DIG. 64, 247, 66, 67, 256.5; 70/208; 74/543, 547; 16/257, 259, 261, 114 R; 220/324

[56] References Cited

U.S. PATENT DOCUMENTS

| | | | |
|---|---|---|---|
| 155,264 | 9/1874 | Snow | 16/114 R |
| 679,539 | 7/1901 | Nosal . | |
| 1,645,849 | 10/1927 | Bell | 292/DIG. 31 X |
| 1,883,437 | 10/1932 | Adams | 74/513 |
| 2,605,123 | 7/1952 | Claud-Mantle | 292/113 |
| 3,209,564 | 10/1965 | Pelcin | 70/208 |
| 3,785,686 | 1/1974 | Armstrong | 292/336.3 |
| 3,797,870 | 3/1974 | Beckman | 70/208 X |
| 3,873,142 | 3/1975 | Reid | 292/DIG. 49 X |
| 3,936,082 | 2/1976 | Swanson | 292/113 |
| 3,954,293 | 5/1976 | Orr | 292/256.5 |
| 4,110,870 | 9/1978 | Weihrauch | 16/114 R |
| 4,116,027 | 9/1978 | Tannery | 70/208 X |
| 4,124,184 | 11/1978 | Juergens | 292/66 |
| 4,243,255 | 1/1981 | Hornak | 292/113 |
| 4,512,122 | 4/1985 | Berkowitz | 292/DIG. 53 X |
| 4,602,812 | 7/1986 | Bouvne | 292/DIG. 31 X |

*Primary Examiner*—Robert L. Wolfe
*Assistant Examiner*—Lloyd A. Gall
*Attorney, Agent, or Firm*—Richard J. Donahue; Donald J. Singer

[57] ABSTRACT

A self protecting toggle latch assembly in which the latch handle nests in a narrow slot cut a part way through the extruded side member of the container. The slot interrupts a hole of circular cross section which is extruded throughout the length of the side member to form a hole on each side of the slot. The handle is pivotally retained in the side member by projections thereon which engage the holes formed in the side walls of the slot.

1 Claim, 9 Drawing Figures

CONTAINER LATCH

STATEMENT OF GOVERNMENT INTEREST

The invention described herein may be manufactured and used by or for the Government for governmental purposes without the payment of any royalty thereon.

BACKGROUND OF THE INVENTION

This invention relates to improved latching means and, more particularly, to an over-center or toggle type latch for releasably securing two adjacent parts, such as for securing a cover to a container.

Over-center or toggle action type latches, per se, are well known. Many toggle latch mechanisms, however, are difficult or impossible to open and close by hand when they are tightened to the high drawbolt loads required to seal containers such as are used to ship munitions and the like. Latch opening and closing forces in excess of one hundred pounds have been measured on some munition containers presently in use, and special tools are often required in order to apply the forces necessary to operate such latches. This is an undesirable situation inasmuch as at least one such special tool must usually be furnished with each container, and quite often the special tool is soon misplaced or lost.

A drawback to many available latches which are designed to be opened and closed by hand is the presence of large exposed surfaces which function as handles. These handles are easily damaged by blows or by the accidental hooking of the handles on adjacent objects. In U.S. Pat. No. 3,954,293 issued to W. A. Orr on May 4, 1976, there is disclosed a self-protecting latch which avoids the aforementioned objectionable feature by eliminating the large exposed handle in favor of a socket, and includes a special channel member having elongated parallel sidewalls which protect to some extent the operative elements of the latch.

A modified embodiment of the self protecting latch shown in the Orr patent, supra, has been used with some government munition containers. It includes a base member in the form of a U-shaped channel or cage having parallel sidewalls of uniform height. The cage is welded to the container at a wide opening formed in the extruded sidewall of the container. The latch mechanism, including a latch handle and its drawbar pivot elements are protected by the cage.

Various flush-mounted latch mechanisms are also known in which the mechanisms have a dished or concave base plate which is mounted by bolts or the like within an opening in the sidewall of the associated container. An example of such a latch mechanism is disclosed in U.S. Pat. No. 2,605,123 issued to A. Claud-Mantle on July 29, 1952.

While the aforementioned patents disclose latching devices which provide a measure of protection against accidental operation or damage, they all require either a special mounting channel, cage or base plate of considerable manufacturing and assembly costs, and they still must be bolted, welded or otherwise affixed to a container, a further cost in terms of both labor and material.

OBJECTS AND SUMMARY OF THE INVENTION

It is therefore the primary object of the present invention to provide a toggle latch assembly of improved construction and performance.

It is a further object of the present invention to provide an improved self-protecting latch assembly of reduced material and labor costs.

In accordance with the present invention, the protective cage, dished base plate or sidewalls for the latch, and the required welding or bolting of the latch to the container are both eliminated by modifying and utilizing the existing extruded rail or side member of the associated container as both a latch protection means and as a mounting base means for pivotally securing the latch handle to the container. A circular opening or hole of constant diameter is initially formed within the extruded side rail of the container and extends throughout the length thereof. The latch assembly is then attached at any desired location along the rail by simply cutting a narrow vertical slot through the rail to establish holes on either side of the slot. A latch handle is inserted into the slot, the handle having tubular projections thereon which are retained within the holes in the rail. When closed, the latch handle is nested within and protected by the side rail of the container.

Other objects, advantages and features of the invention will become apparent from the following detailed description of the invention when read in conjunction with the annexed drawings.

DETAILED DESCRIPTION OF THE INVENTION

Figure 1:
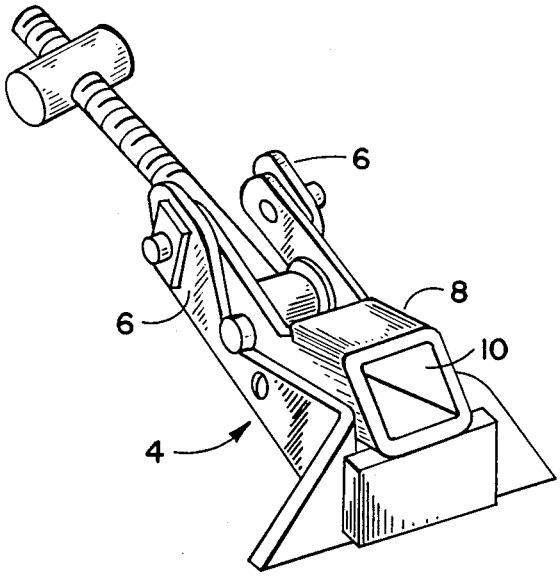
FIG. 1 PRIOR ART
FIG. 1 is a perspective view of a prior art self-protecting toggle latch mechanism.

Referring now to the drawings, in FIG. 1 there is shown a perspective view of a self-protecting type of toggle latch which was designed for use with munition shipping containers, and is disclosed in the aforementioned U.S. Pat. No. 3,954,293. Important structural details of this latch include the channel 4 whose raised side members 6protect the shortened lever element 8 which has a socket 10 therein for receiving a removable handle or tool. As previously mentioned, special protective devices, such as channel 4, add to the cost and complexity of such a latch. And it is still necessary to weld or otherwise affix the latch to the side of a container.

Figure 2:
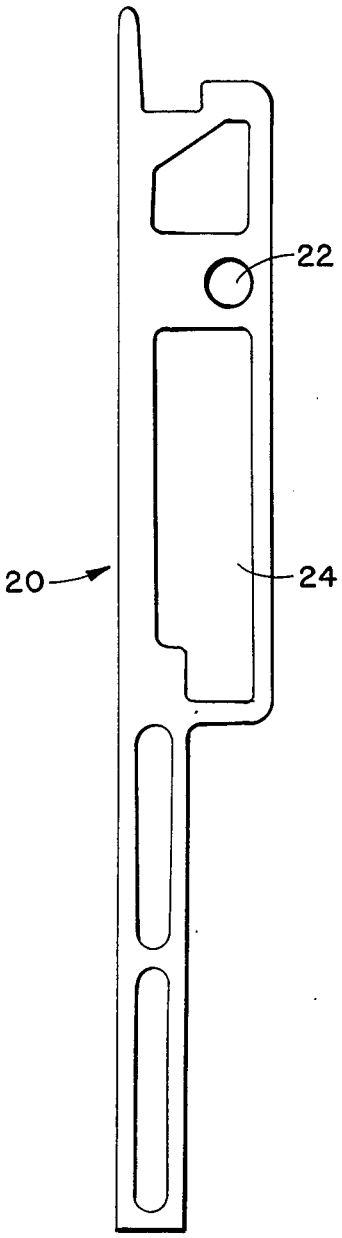
FIG. 2 is an end view of the extruded side rail or wall of the present invention.

Many containers such as those used for storing munitions often have side walls which are either completely formed of hollow extruded material such as aluminum, or have hollow extruded aluminum rail members which surround the top of the side walls in order to add strength and rigidity to the container. Such extruded side walls or rails which have been used to date are similar to the extruded rail 20 shown in end view in FIG. 2 of the drawings, with perhaps one notable difference, that is the presence of a circular hole 22 therein. Hole 22, which has a fixed diameter and is extruded throughout the length of rail 20, is not specifically provided herein to reduce the weight and material cost of the side rail, but functions as an operative part of the latch assembly for the container.

It will become apparent as this description proceeds, that if a narrow slot is cut transversely through rail 20, a toggle latch handle can be pivotally affixed to the pair of holes formed on the opposed sides of the slot. Further, that the entire handle can be nested below the surface of rail 20, in the space provided by rectangular cavity 24. By nesting the latch handle below the surface of rail 20, it is protected from damage by accidental blows, especially lateral blows, which it could otherwise receive. It will also be apparent that additional slots may be cut through the extruded rail 20 to accomodate additional latch handles.

Figure 3:
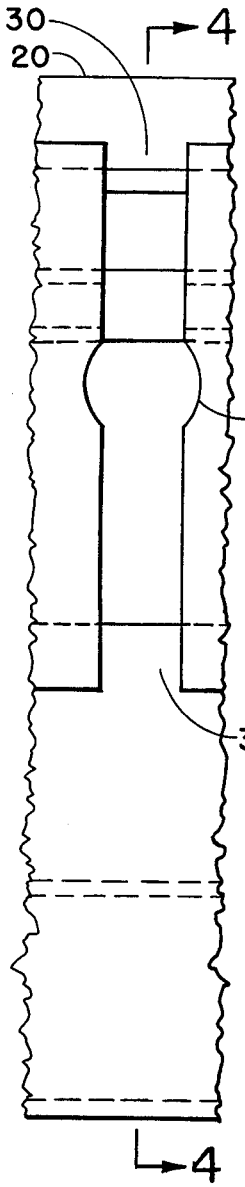
FIG. 3 is a side view of the extruded side rail of the present invention having a latch-retaining slot formed therein.

FIG. 3 is a side view of a short length of the extruded side rail 20 in which a narrow slot 30 has been cut to accommodate a latch handle. This slot may be in the order of one half inch wide as compared to openings of three inches or more wide which were previously required in order to accommodate and weld a latch and its protective cage in this area. The narrower the slot of the present invention increases the strength and rigidity of the container.

Figure 4:
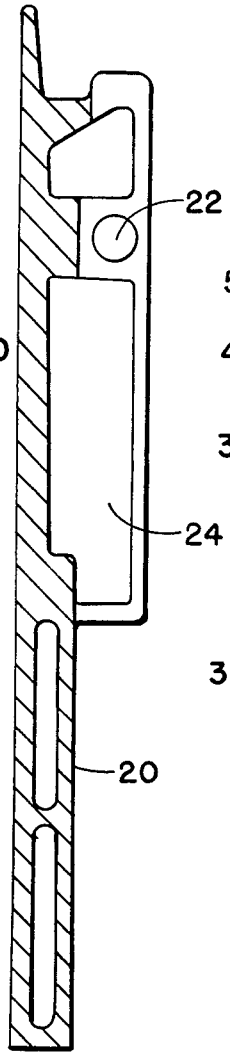
FIG. 4 is a cross-sectional end view of the side rail of the present invention taken through the lines 4—4 of FIG. 3.

FIG. 4 is an end view of side rail 20 taken through the section 4—4 of FIG. 3, and illustrates in cross-section the portion of the side rail 20 which remains intact after the slot 30 has been cut partially through the thickness dimension of side rail 20.

Figure 5:
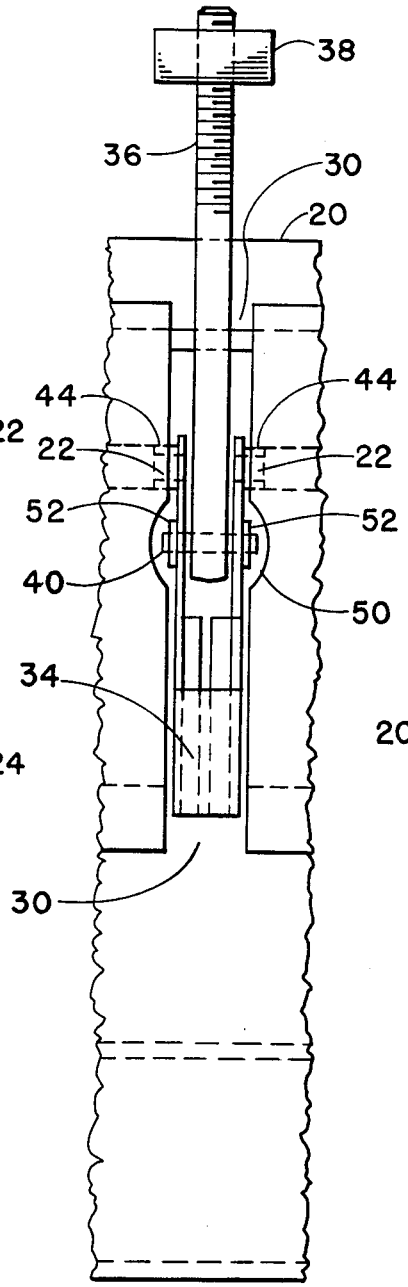
FIG 5 is a side view of the side rail of present invention with the latch handle and drawbar assembled therein.
Figure 6:
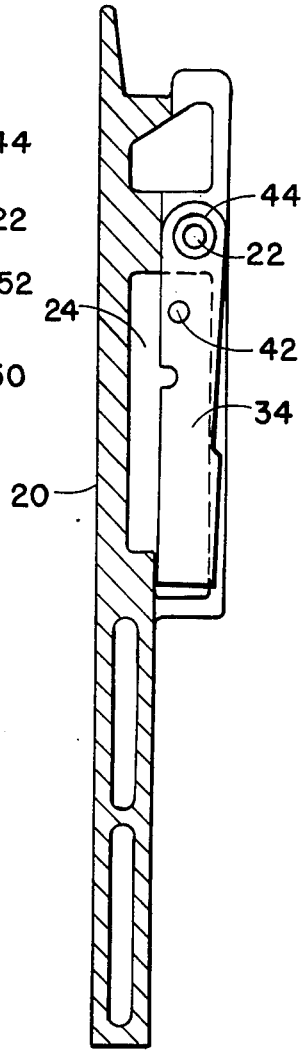
FIG. 6 is a cross-sectional end view of the side rail of the present invention with the latch handle assembled therein.

FIGS. 5 and 6 are side and end views respectively of side rail 20 after insertion therein of a latch handle 34. In FIG. 5, the drawbar 36 associated with latch handle 34 is illustrated, while in FIG. 6, drawbar 36, which is of conventional design and operation has been omitted in order to better show other elements of the latch assembly. Drawbar 36 will be seen to be similar to the drawbar shown in the prior art device of FIG. 1, and is similarly threaded at one end thereof to permit adjustment of barrel nut 38 which engages a striker on the cover of an associated container. The other end of drawbar 36 is pivotally affixed to latch handle 34 via king pin 40 inserted through drawbar 36 and through the holes 42 in latch handle 34.

It will be seen from FIGS. 5 and 6 that latch handle 34 extends in a widthwise direction of side rail 20 and nests entirely within side rail 20 and is thereby protected from damage or accidental operation. Slot 30 may be slightly enlarged in the area 50 adjacent king pin 40 to provide clearance for retaining elements 52 on each end of king pin 40. The enlargement of slot 30 in only this small area keeps the width of the slot at a minimum to retain the strength of the container.

Figure 7A:
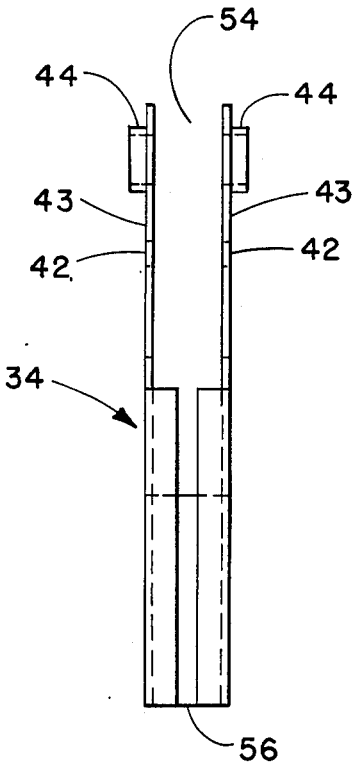
FIGS. 7A, 7B and 7C are enlarged back, side and bottom end views respectively of the latch handle of the present invention.
Figure 7B:
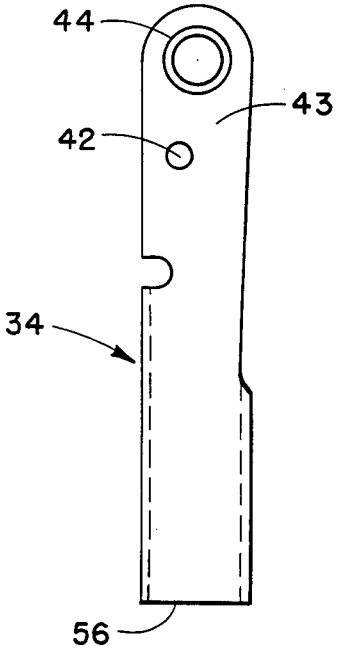
Figure 7C:
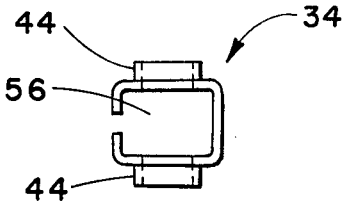

FIGS. 7A, 7B and 7C provide slightly enlarged views of latch handle 34, which is seen to have a pair of parallel finger-like members 43 with tubular projections 44 formed thereon which engage holes 22 in side rail 20. Latch handle 34 is preferrably formed of folded sheet metal and the finger-like members 43 can be compressed to urge the tubular projections 44 near end 54 of latch handle 34 into slot 30 to engage holes 22. The other end 56 of latch handle 34 is open and will accommodate a tool for opening the latch, if desired or required.

It will be seen from FIG. 5 that the presence of drawbar 36 between the finger-like members 43 of latch handle 34 prevents the projections 44 from being pulled out of holes 22 when extremely high forces are applied to latch handle 34.

The latch assembly disclosed herein operates in a conventional manner. The over-center locking feature is provided by the offset pivot points of projections 44 and drawbar holes 42.

Although the invention has been described with reference to a particular embodiment thereof, it will be understood to those skilled in the art that the invention is capable of a variety of alternative embodiments within the spirit and scope of the appended claims.

What is claimed is:

1. A toggle latch assembly for releasably securing a cover to a container comprising:

a container having at least one extruded side member with an integral cavity of circular cross-section extending throughout the length of the interior thereof;

said side member having a slot cut at least part way therethrough and of sufficient depth to expose said cavity of circular cross-section and thereby establish a pair of holes at the opposed sides of said slot;

said side member having a preselected width and having a length substantially greater than said width such that plural slots may be cut therethrough;

a latch handle adapted to fit within said slot and having a pair of projections extending outwardly therefrom, each one of said pair of projections engaging one of said pair of holes to pivotally affix said latch handle to said side member; and a drawbar pivotally affixed to said latch handle having means thereon for engaging a cover for said container wherein said pair of projections extending from said latch handle are tubular projections and wherein said side member is of sufficient width and said slot in said side member is of sufficient depth to permit the nesting of said latch handle entirely below the exposed surface of said side member.

* * * * *